United States Patent [19]

MacLean

[11] 4,015,849

[45] Apr. 5, 1977

[54] CHESS-LIKE GAME

[76] Inventor: Charles A. MacLean, 23073 Beech, Dearborn, Mich. 48124

[22] Filed: Oct. 29, 1975

[21] Appl. No.: 626,940

[52] U.S. Cl. ..... 273/131 KC; 273/137 R
[51] Int. Cl.[2] ..... A63F 3/02
[58] Field of Search ..... 273/131

[56] References Cited

UNITED STATES PATENTS 3,466,044 9/1969 Somerville ..... 273/131 AD

*Primary Examiner*—Delbert B. Lowe
*Attorney, Agent, or Firm*—Basile, Weintraub and Vanophem

[57] ABSTRACT

A chess-like game for use by two players and comprising a checkerboard having a checkered playing area with ranks and files of bilaterally alternating colored spaces. A set of chess pieces consisting of a subset of eight royalty figures for one of the players are initially positioned to form a royalty row along the rank at the edge of the playing area. The chess pieces further comprise a subset of eight pawn figures for the one player and are initially positioned on the playing area in the row adjacent the row occupied by the royalty figures to form a pawn row in front of the royalty row, as is conventional in the game of Chess. The set further comprises a subset of six horsemen-like figures which are representative of war, famine, plague, death, fire, and vanity, and each horsemen figure has the ability to move on the checkered playing area in a manner that symbolizes the attribute of the name which it bears.

1 Claim, 9 Drawing Figures

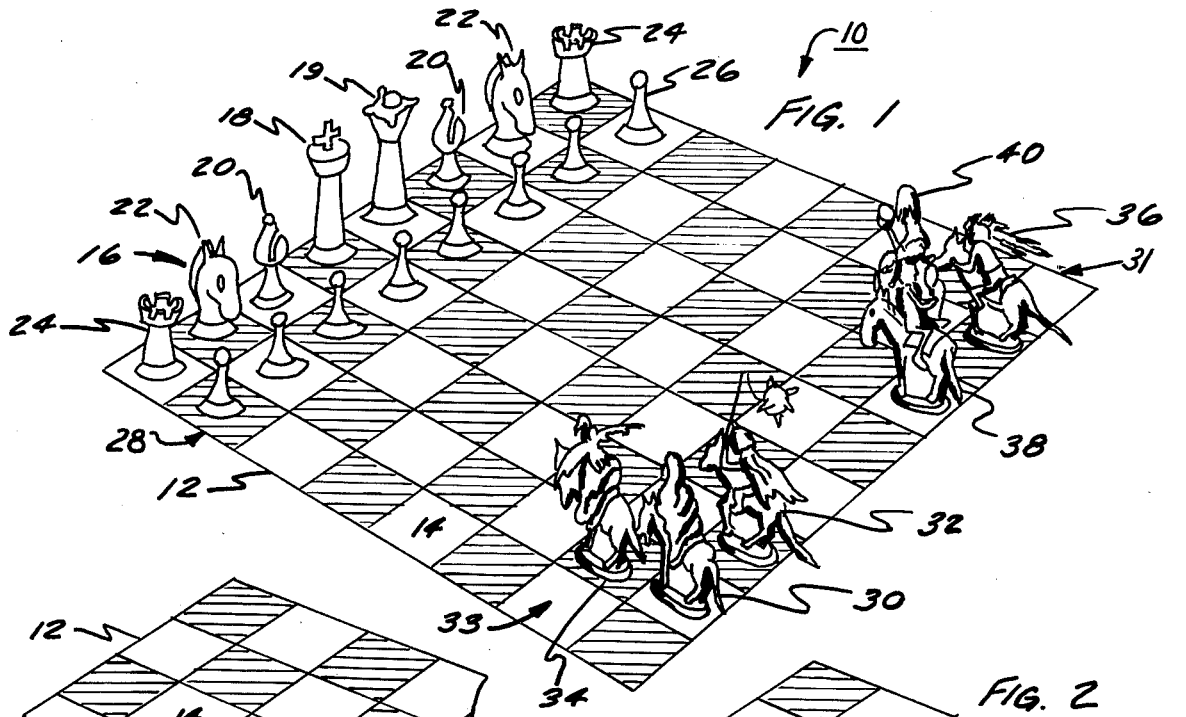
FIG. 1
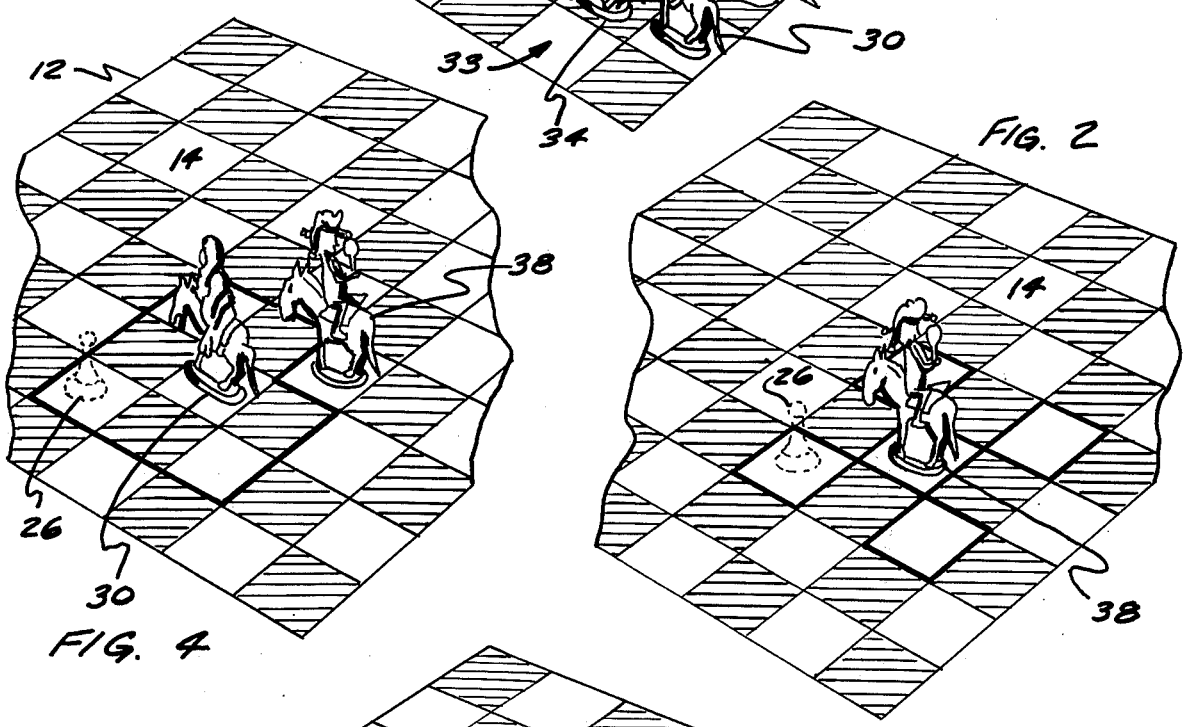
FIG. 2
FIG. 4
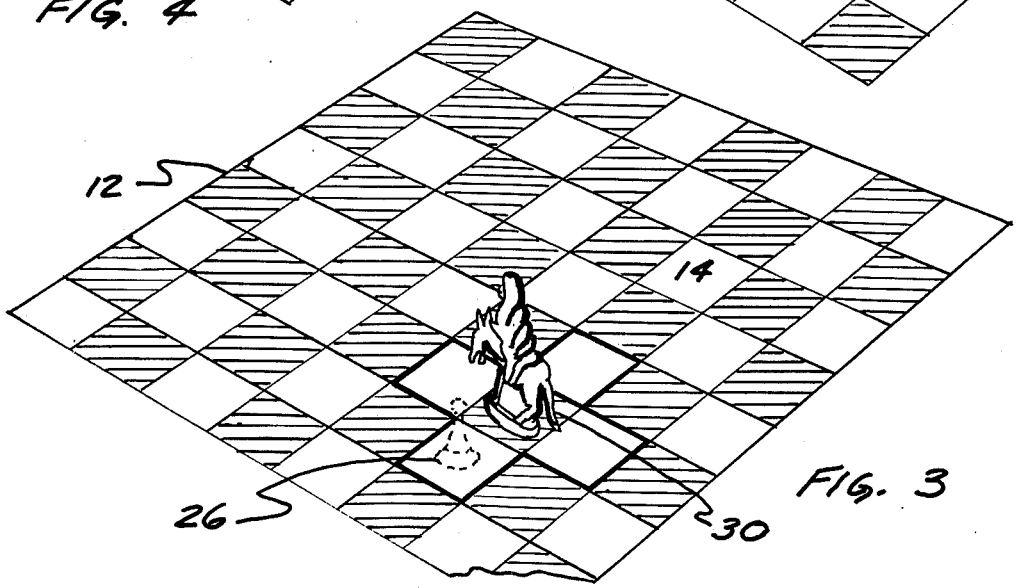
FIG. 3

CHESS-LIKE GAME

BACKGROUND OF THE INVENTION

1. Field of the Invention

The present invention relates to chess-like games and, more particularly, to a game wherein conventional chess pieces are employed by one of two players and wherein the chess pieces represent Humanity, while the second player employs a plurality of horsemen figures representative of specific human problems.

2. Description of the Prior Art

Chess is one of the world's oldest games, and over the years Chess has been played by millions of people. The classic Chess game simulates a relatively simple war situation wherein two opponents each start with a set of royalty figures including a king, a queen, a pair of bishops, a pair of knights, and a pair of rooks, plus a set of eight pawns which are initially positioned to protect the more powerful royalty figures. The classic Chess game has remained relatively unchanged throughout the years; however, attempts have been made to provide variations of the game and to update the game to simulate modern-day activity. Examples of prior art patents which disclose chess-like games that have been modified are illustrated in U.S. Pat. Nos. 1,056,526; 1,877,154; and 3,873,101.

While these examples of the prior art chess-like games have provided new and improved means for modifying the basic game of Chess, they do not achieve the full potential that applicant's invention discloses.

SUMMARY OF THE INVENTION

The present invention, which will be described herein in greater detail, comprises a chess-like game wherein one of two players employs a conventional chess set of sixteen pieces to simulate a battle of Humanity against an enemy in the form of horsemen figures which symbolize specific human evils and problems with each of the specific horsemen figures involved having a move which is an allegory of the attributes of the particular evil and the name which the specific horseman bears.

It is therefore an object of the present invention to provide a chess-like game which expands the basic Chess game to a fuller potential for providing a challenging and interesting game for the players.

Other objects, advantages, and applications of the present invention will become apparent to those skilled in the art of chess-like games when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to similar components throughout the several figures, and wherein:

FIG. 1 is a perspective view of the inventive chess-like game positioned on a checkerboard illustrating the game setup ready for use by two players;

FIG. 2 is a perspective view of the checkerboard illustrating the moves of the horseman figure of vanity;

FIG. 3 is a perspective view of the checkerboard illustrating the moves of the horseman figure death;

FIG. 4 is a perspective view of the checkerboard illustrating the interplay between the moves of the horsemen figures death and vanity;

DESCRIPTION OF THE PREFERRED EMBODIMENT

Figure 5:
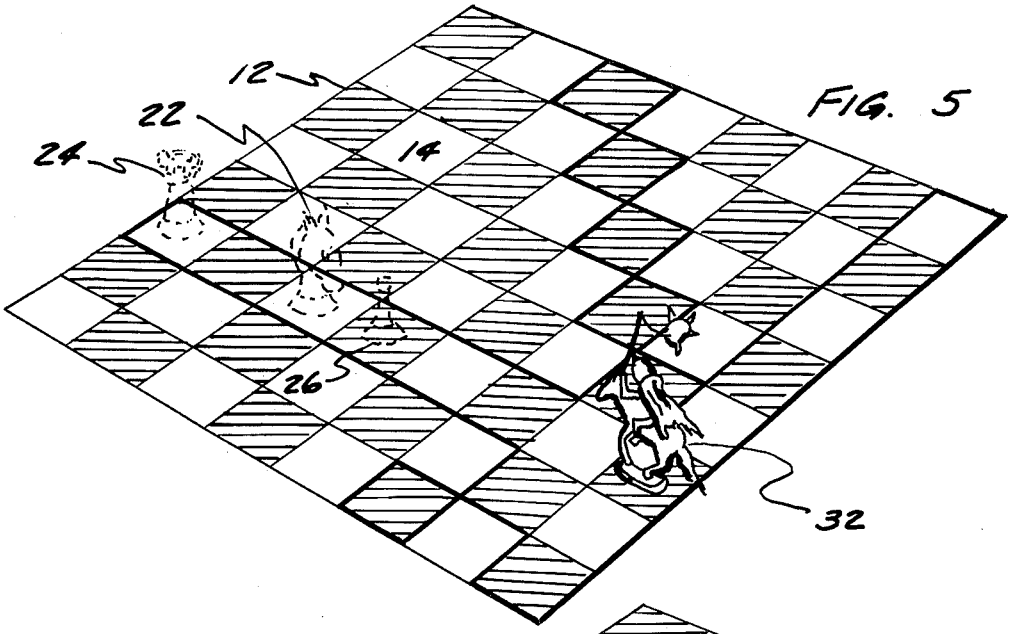
FIG. 5 is a perspective view of the checkerboard illustrating the moves of the horseman figure war.

Referring now to the drawings and, in particular, to FIG. 1 wherein there is illustrated one example of the present invention in the form of a chess-like game 10 comprising a checkerboard 12 having positioned thereon a set of chess pieces which will be described in greater detail hereinafter. The checkerboard 12 is a conventional checkerboard having eight squares 14 on a side for a total of 64 squares. The squares 14 alternate in color to provide ranks and files forming squares of bilaterally alternating colors.

The initial setup for the chess-like game 10, according to the present invention, is illustrated in FIG. 1 and includes a royalty row 16 for the north player. The royalty row 16 includes a king 18, a queen 19, a pair of bishops 20, a pair of knights 22, and a pair of rooks 24. The royalty row 16 is aligned along the north edge of the center board in a customary fashion. Pawns 26 are in the north pawn row 28 located on the checkerboard 12 adjacent to royalty row 16, and to this point the setup of the chessmen on the checkerboard 12 is the same as in a conventional chess game.

On the south side the second player of the chess-like game 10 is provided with six horsemen figures including a death horseman 30, disposed in the second space of the row 31 along the south edge of the board, while a war horseman 32 is disposed in the space immediately adjacent thereto. A plague horseman 34 is disposed in row 33 immediately adjacent to the row 31 and in front of the death horseman 30. A fire horseman 36 is located in the second space of row 31, while a vanity horseman 38 is positioned immediately adjacent to the fire horseman 36, while a famine horseman 40 is positioned in row 33 immediately in front of the fire horseman 36. The subset of eight royalty figures, the subset of eight pawn figures, and the subset of the six horsemen figures comprise the set of pieces necessary to play the inventive game and are illustrated in FIG. 1 in the initial game setup ready for use by the two players; that is, the north and south players.

The central theme of applicant's invention is that mankind (or humanity) is confronted by many evils which seemingly seek to overwhelm mankind. Mankind of humanity is represented by the conventional 16 chessman hereinbefore described. The 16 chessmen, as will be described hereinafter, start from the conventional position and follow the conventional rules of Chess. The south side horsemen represent the concentration of the specific human problems of evils which mankind is confronted by. The specific horseman involved has a move which is an allegory of the attributes of the particular evil which it represents. As will be described hereinafter in the description of the moves of the various figures, the game commences with the chessmen moving first with the object of the game being for the horsemen to checkmate the chess king 18. Similarly, the object of the chessmen is to checkmate the king of the evil horsemen; namely, the vanity horseman 38.

The king 18 is adapted to move one square at a time in any direction; that is, backward, forward, laterally, or diagonally. The queen 19 is one of the most powerful pieces on the chessmen side of the board and can be moved any number of squares in any direction; that is, backward, forward, sideways, or diagonally on an unobstructed range. The rook 24 is the next most powerful piece for the chessmen, and it moves in a straight line backward or forward or laterally but not diagonally. The bishop 20 moves diagonally but only on squares of its own color. The knight 22 moves one square diagonally and one square straight, and alone of the chess pieces has the priviledge of jumping over other pieces of pawns whether of its own or opposing forces.

The pawn 26 moves forward one square at a time; however, on its first move only it may move one or two squares at the player's option.

In the following description of the horsemen figures, the drawings representing the areas of the checkerboard 12 on which a particular horseman may be moved are outlined in black for ease of illustration and understanding.

Figure 9:
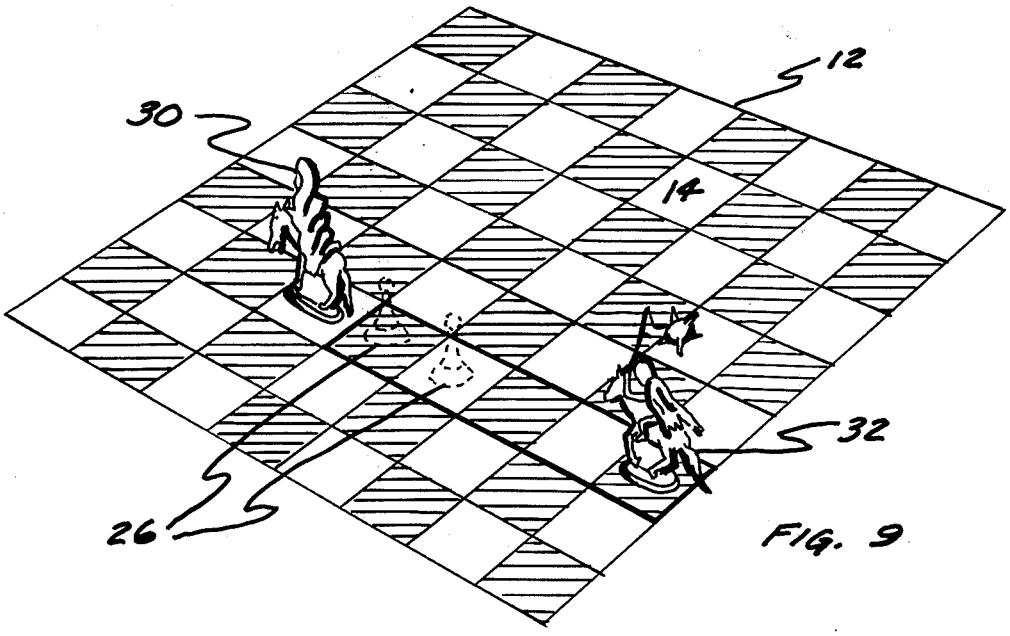
FIG. 9 is a perspective view of the checkerboard illustrating the interplay between the moves of the horsemen figures war and death.

The war horseman 32 is the most dynamic of the horsemen figures but is actually only the second most powerful. War represents an irresistible force and one which is uncontrollable. As such, allegorically, the war piece 32 is an all-or-none piece that cannot be stopped once it commences to move until it encounters either the edge of the checkerboard 12 or the death horseman 30. As can best be seen in FIG. 5, the war horseman 32 moves in a manner similar to the chess piece queen 19, that is, the war horseman figure 32 is movable in a straight line along any appropriate rank, file, or diagonal; however, the war horseman figure 32 will stop short of the edge of the checkerboard 12 as shown in FIG. 5 or short of the death horseman 30 as shown in FIG. 9. The war horseman 32 is the only horseman figure that may take more than one opposing chess piece simultaneously. The war horseman 32 captures all pieces (in fact it must capture all pieces if it moves) along the rank, file, or diagonal that the war horseman 32 is moved on. Thus, as can be seen in FIG. 5, if the war horseman 32 is moved along the rank wherein the pawn 26, the knight 22, and the rook 24 are illustrated in phantom lines, all three pieces will be taken by the war horseman 32; and the war horseman 32 will come to a stop at the north edge of the checkerboard 12. In FIG. 9 the war horseman 32 moves across the file to take the two pawns 26 and is stopped by the death horseman 30. It should be noted that no piece on either side may capture a piece of the same side, and thus the war horseman 32 may not move even a single square along a rank, file, or diagonal that contains one or more horsemen unless the first horseman that it will encounter would be the death horseman 30. As aforementioned, the war horseman 32 comes to rest on the square at the edge of the checkerboard or on the square just before and adjacent to the death horseman, as shown in FIG. 9.

Figure 6:
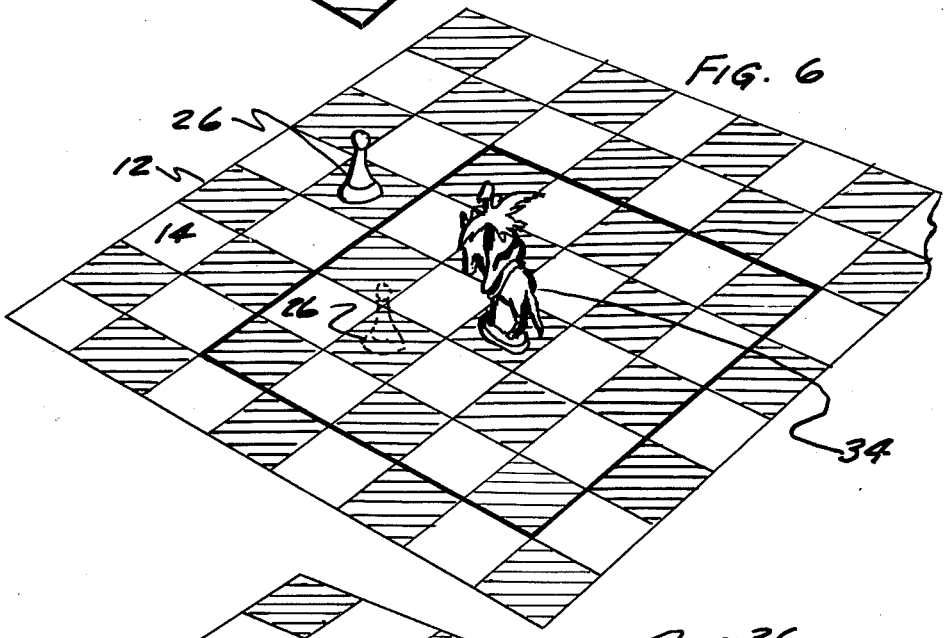
FIG. 6 is a perspective view of the checkerboard illustrating the moves of the horseman figure plague.

The plague horseman 34 should be considered as representing not only all of the infectious deseases but all human deseases apart from those which relate to pure starvation. Plague horseman 34 therefore is truly representative of the most powerful piece in the game depending upon its specific position. The plague horseman 34 may be moved to and/or capture anything within a radius of two chess squares including ranks, files, diagonals, and moves similar to the chess knights 22, all of which is schematically illustrated in FIG. 6. Thus, the plague horseman 34 has only to move anywhere within two squares of the chess king 18 in order to check, but not necessarily mate, the chess king 18. Since famine theoretically can permeate virtually all obstacles, the plague horseman 34 can leap over intervening spaces in a manner similar to the chess knight 22; however, the choice of landing sites for the plague horseman 34 is substantially greater.

Figure 8:
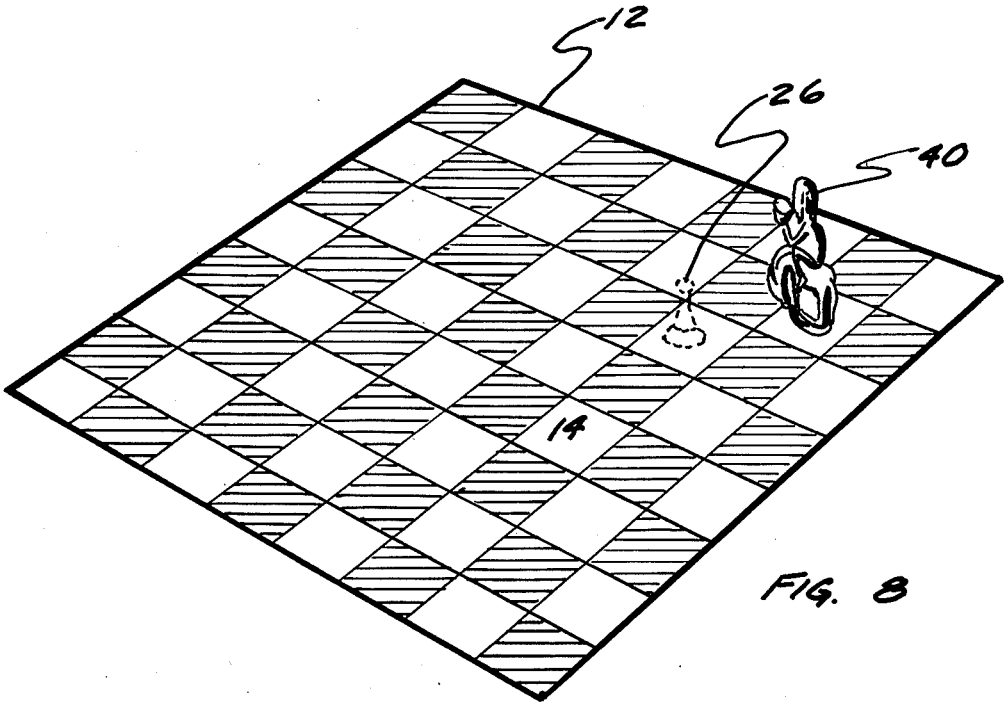
FIG. 8 is a perspective view of the checkerboard illustrating the moves of the horseman figure famine.

The famine horseman 40, which is illustrated in FIG. 8 of the drawings, is representative of the slow killer that famine may be in real life; and similar to famine the horseman 40 may turn up wherever the circumstances make it possible. Thus, for the famine horseman 40 the move of capture is modest, but the move of ordinary progression is greater than that of any other horseman or chess piece. The famine horseman 40 may capture only one square in any direction similar to the chess king 18; however, the famine horseman 40 may move to any unoccupied square on the entire board leaping any and every obstacle to reach the selected unoccupied square.

Death in the ordinary course of human life-time, unaided by any other evil, mischance, or folly, approaches at a very slow pace; and thus the death horseman 30 progresses at only one square at a time to a square of the same rank or file, but the death horseman 30 may not move to an unoccupied diagonal square. Conversely the death horseman 30 can ordinarily only capture a piece on an adjacent diagonal square and not a piece on the same rank or file, as schematically illustrated in FIG. 3. Since in real life death is made much more likely by the presence of vanity, in the present inventive game the death horseman 30 has increased powers and movability when the death horseman 30 and the vanity horseman 38 are immediately adjacent. In such situations as illustrated in FIG. 4 of the drawings, the death horseman 30 may move in a manner similar to the chess king 18, moving in any adjacent square and capturing any occupying opposing piece when the death horseman 30 so moves. The death horseman 30 is considered one of the most powerful pieces in the inventive game, as death being what it is, it cannot itself be killed; hence, the death horseman 30 cannot be captured by the opposing side. It should also be noted that since death can stop war, death can be situated near the center of the checkerboard 12 to provide a means for positioning the war horseman 32 at a central position on the checkerboard 12.

Figure 7:
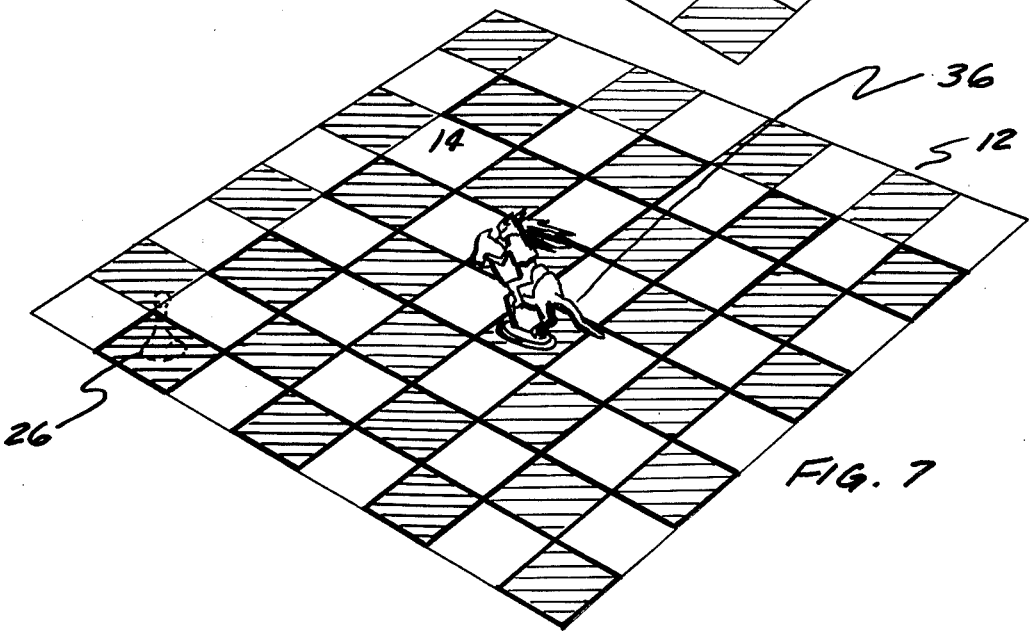
FIG. 7 is a perspective view of the checkerboard illustrating the moves of the horseman figure fire.

The fire horseman 36 should be considered as representing not only fire per se but all natural disasters. The fire horseman 36 resembles the chess bishop 20 in that the fire horseman 36 can only move to squares of the same color that the fire horseman 36 started on; however, the fire horseman 36 can turn corners as the bishop cannot. The fire horseman 36 can move to and/or capture along any combination up to three adjacent squares of the same color; however, the fire horseman 36 need only move one or two as desired. The fire horseman 36 and its various moves are schematically illustrated in FIG. 7 of the drawings; and, in particular, the pawn 26 is illustrated as being three diagonally moved spaces away from the fire horseman 36 and may be taken thereby.

The vanity horseman 38, illustrated in FIG. 2 of the drawings, is representative of the true king of all evils; and humanity, represented by the chess pieces, wins by directly attacking vanity 38. While vanity, in and of itself renders the other horsemen more potent, it is an extremely weak piece in and of itself. As can best be seen in FIG. 2, the vanity horseman 38 is adapted to move and/or capture only one square at a time and only diagonally in any direction. Humanity, represented by the conventional chess pieces, wins by checkmating the vanity horseman 38. It should be noted that while in an ordinary chess game kings can never mate, chess king 18 can move to a square adjacent the vanity horseman 38 and in appropriate circumstances can actually effect a checkmate, single handed if necessary. While the vanity horseman 38 can capture the opponent's pieces without putting itself in check, the vanity horseman 38 cannot directly attack the chess king. While specific opening variations and detailed treatment of the general tactics and strategy can be developed by individual players through the use of the game, it is important to remember that all the rules of chess apply even though altered in the aforementioned manner. For example, no move may be made that would place one's own king, whether it be the chess king 18 or the vanity horseman 38, in check. It should also be noted that ordinarily the game may proceed to the point where only the two kings are left, which is a draw position. In applicant's inventive game the final position, win, lose, or tie, must always include at least vanity, death, and the chess king.

It can thus be seen that applicant has disclosed a new and improved chess-like game which tends to expand the basic chess game to its full potential by providing a challenging and interesting game for two opponents.

It should be understood by those skilled in the art of chess-like games that other forms of the present invention may be had, all coming within the spirit of the invention and scope of the appended claims.

What is claimed is as follows:

1. A chess-like game for at least two players comprising:

a checkerboard playing area with ranks and files of bilaterally alternating colored spaces;

a first set of chess pieces comprising a subset of eight royalty figures for one of the two players initially positioned to form a royalty row along one rank at the edge of said checkered playing area;

a subset of eight pawn figures for said one player initially positioned on said playing area in the rank adjacent the rank occupied by the royalty figures to form a pawn row in front of said royalty row; and a set of six horsemen figures for the other player, said figures of said last-mentioned set each differing from the others and being visually distinguishable from said royalty figures and said pawn figures.

* * * * *